US006967450B1

(12) United States Patent
Durlach

(10) Patent No.: US 6,967,450 B1
(45) Date of Patent: Nov. 22, 2005

(54) MOVING BANNER DISPLAY IMPROVEMENTS

(76) Inventor: David Milton Durlach, 11 Miller St., Somerville, MA (US) 02143

( * ) Notice: Subject to any disclaimer, the term of this patent is extended or adjusted under 35 U.S.C. 154(b) by 74 days.

(21) Appl. No.: 10/437,563

(22) Filed: May 13, 2003

Related U.S. Application Data

(60) Provisional application No. 60/380,548, filed on May 13, 2002.

(51) Int. Cl.[7] ..... G09F 17/00
(52) U.S. Cl. ..... 318/372; 40/429; 40/606.11
(58) Field of Search ..... 318/372, 558; 40/421, 423, 427, 429, 430, 436, 553, 572, 40/606.01, 606.11

(56) References Cited

U.S. PATENT DOCUMENTS 3,620,335 A * 11/1971 Hendershot et al. ..... 192/21.5
3,678,282 A * 7/1972 Johnson et al. ..... 250/559.29
3,997,993 A 12/1976 Flaherty
5,046,274 A 9/1991 David
5,088,219 A * 2/1992 Toraby-Payhan ..... 404/71
5,555,659 A 9/1996 Hade
5,562,459 A 10/1996 Durlach
5,573,088 A 11/1996 Daniels

* cited by examiner

*Primary Examiner*—Bentsu Ro

(57) ABSTRACT

Enhancements for moving displays in general, and in particular, dynamic signage and kinetic sculpture. More specifically, the present invention relates to improvements on moving banners (18) for use within entertainment, advertising, signage, art, theater, performance visual instruments, and attraction contexts.

Improvements are cost-saving computer controlled torque friction brakes (16), substantially inelastic reinforcing cable (20) to allow elastic banners (18) to handle relatively higher wind loads, and reusable removable printed image banner sleeves (22).

10 Claims, 3 Drawing Sheets

Fig B1
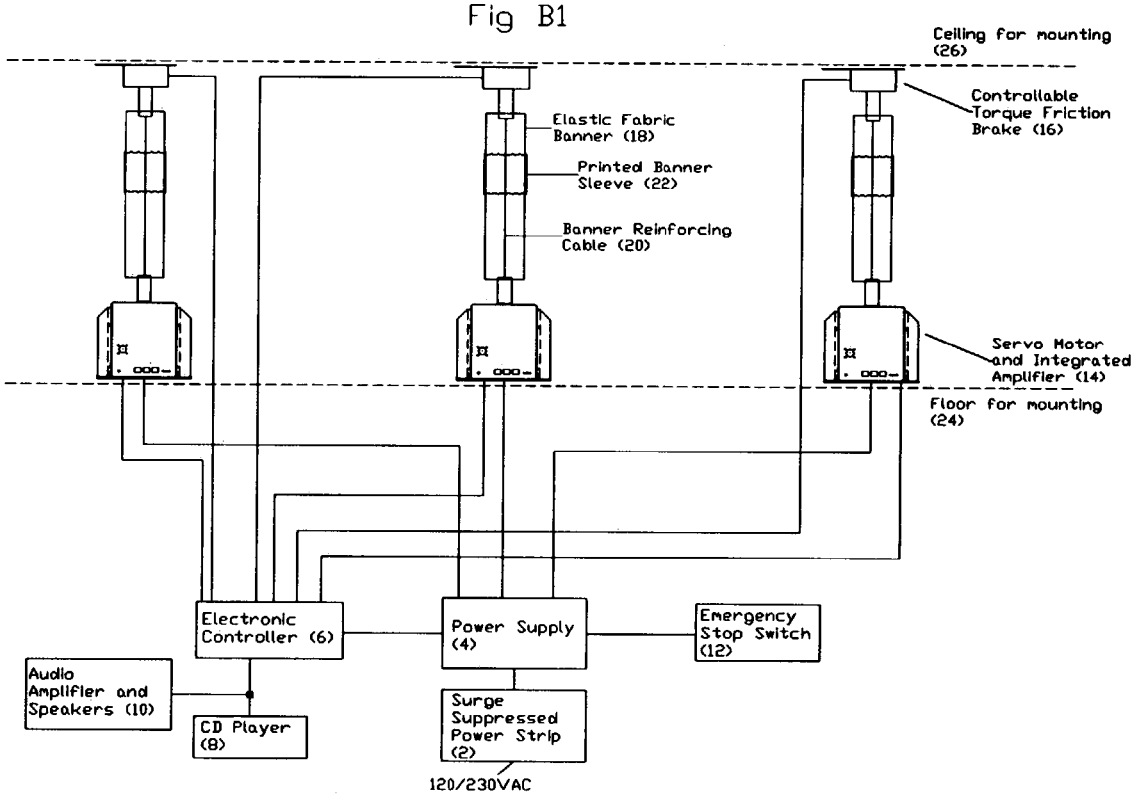

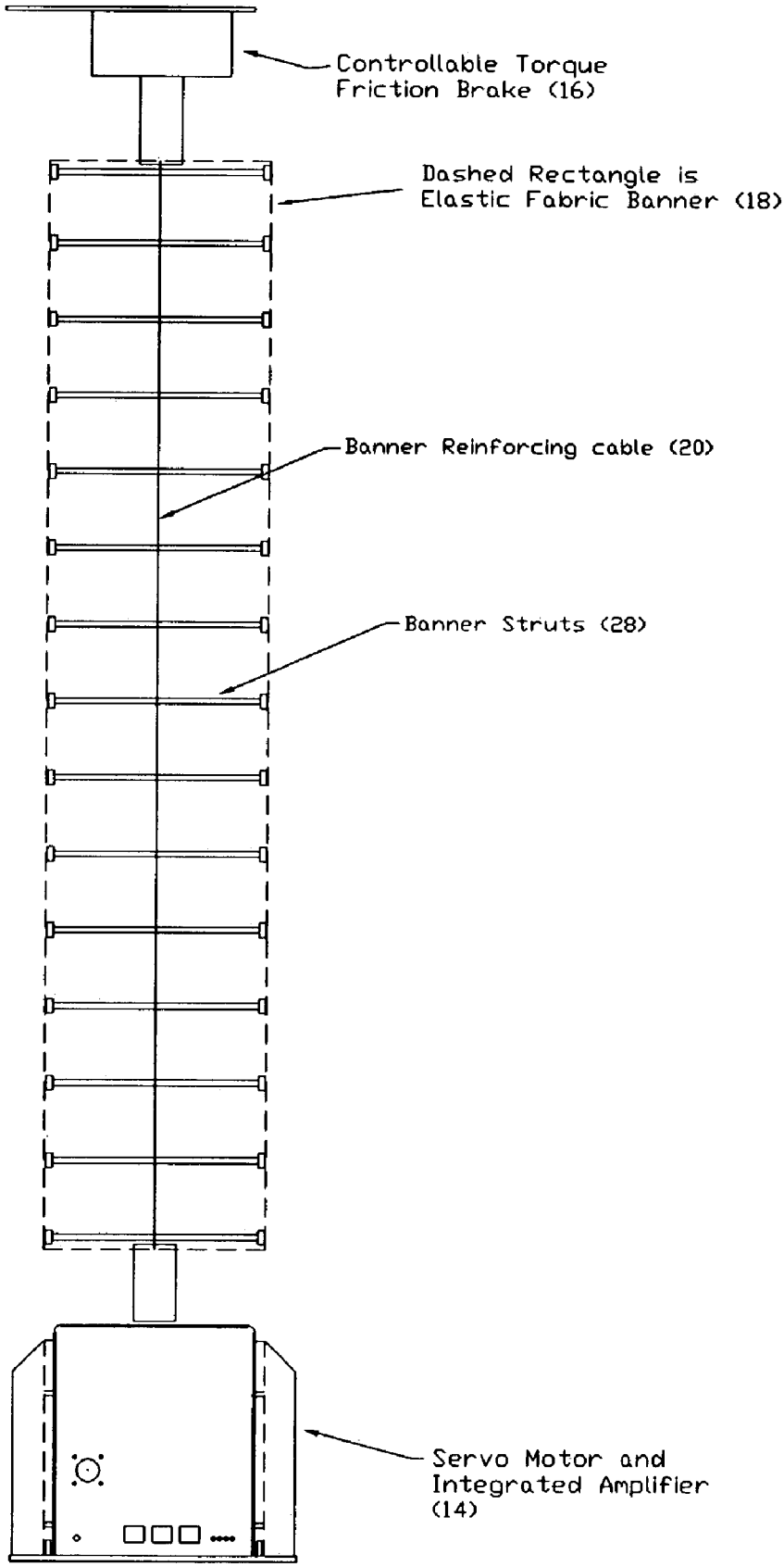
Fig M2

Fig. M3
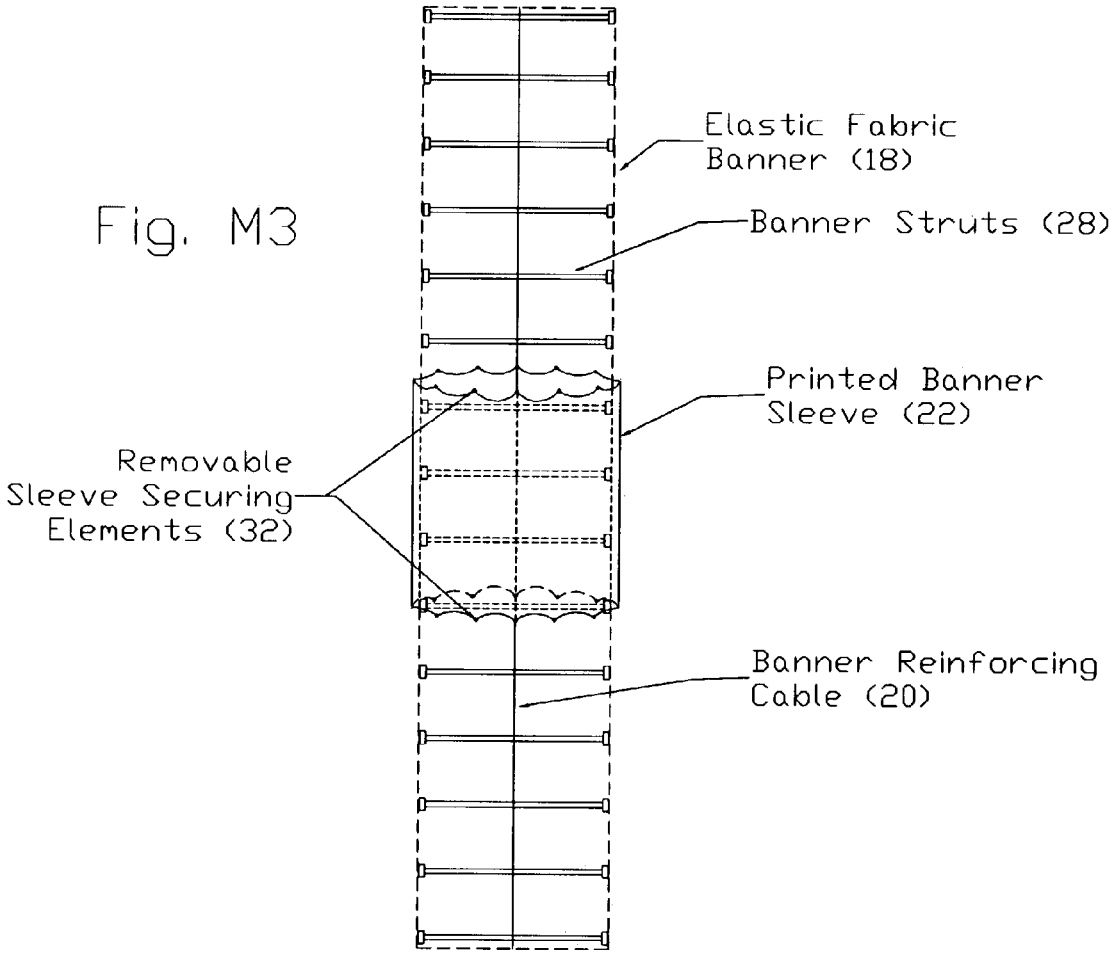

MOVING BANNER DISPLAY IMPROVEMENTS

CROSS-REFERENCE TO RELATED APPLICATIONS

This application is entitled to the benefit of Provisional patent Application Ser. No. 60/380,548 filed 2002, May 13.

FEDERALLY SPONSORED RESEARCH

N/A

SEQUENCE LISTING OR PROGRAM

N/A

Background

1. Field of Invention

The present invention relates to moving displays in general, and in particular, dynamic signage and kinetic sculpture. More specifically, the present invention relates to improvements on choreographed moving banners developed previously by above-named inventor/applicant David Durlach, for use within entertainment, advertising, signage, art, theater, performance visual instruments, and attraction contexts.

2. Discussion of Prior Art

In the 1990s, inventor/applicant, David Durlach developed a fabric banner animation system, marketed under the trade name "Dancing Banners™".

This core system includes:

Computer controlled servo motors at one or both ends of each banner. In the case of one motor only, typically the banner hangs from the motor in the vertical direction with the lower end unattached and free.

Associated power amplifiers to drive the motors.

Microcontroller, ROM/RAM/AS IC/FPGA, and/or computer-based animation control electronics to specify the motion of the motors.

Elastic fabric banners with an internal "backbone" lattice made of many struts, secured to and spaced appropriately along the banner length, that prevent banner collapse/fold-over under high speed accelerations and motions.

Groups of these banners can be choreographed to perform complex twisting dances, in synchrony with each other, under computer control, or via an interactive user interface.

While this animated display system in its original form is a powerful attention-getter, sign, and kinetic artwork, it suffers from three significant drawbacks.

1. Regarding the control motors:

Having a computer controlled motors at both ends of the banner, while providing a great deal of control allowing for complex choreography, makes the display dramatically more expensive than if just a single motor at one end of the banner is used.

However, if only one end of the banner has a motor, then:

If the other end is left hanging free, it is impossible to create dramatic slow or static twists in the banner, for the free end will instantly "unwind". Thus, choreography options, and the resultant attractiveness of the display, are significantly reduced.

If the non-motor end of the banner is permanently affixed to an immovable surface, then while static twists are possible, all exciting multiple spins and rotations are lost.

Various methods have been tried to address these issues, including:

Brakes whose resistance is proportional to velocity—for example, a standard permanent magnet DC motor with its leads shorted. This was unacceptable because again, slow or static twists were impossible to achieve.

Having the non-motor ends of several banners mechanically linked by gears and timing belts.

This mechanical constraint so limited possible motions as to make the display virtually unchoreographable.

2. Regarding changing imagery on the banners:

While printing directly onto the banner fabric itself is aesthetically pleasing, the cost of completely remaking the banner, including full-banner printing and internal lattice attachment, each time new imagery is required, is in most cases sufficiently expensive as to make rental costs prohibitive. This problem is made even more acute by the fact that since most CMYK printing requires a white fabric substrate, desire for a background banner color of something other than white requires 100% banner printing, even though the foreground imagery of interest may be quite small proportionately.

In addition, conventional CMYK printing processes do not provide the kind of vibrant colors that is offered by factory dying.

3. Regarding installation in windy environments:

In the banner's original design, gusts of wind have the potential to "spinnaker" out the banners, causing mechanical harm through damage to the fabric.

OBJECTS AND ADVANTAGES

Accordingly, several objects and advantages of the present moving banner enhancements are:

1. To allow complex diverse Dancing Banners™ choreography, including in particular dramatic slow and static twists, as well as high speed spins, using only one servo motor per banner instead of two, thus dramatically lowering the system cost.

2. To allow for inexpensive changeable and reusable imagery on the banners, and to allow for the use of vibrant and inexpensive factory dyed colors, intermingled with conventional CMYK printing of specific foreground imagery (with the latter often small in area, and thus low in printing cost, compared to the total banner area). Further, to allow for simple enough image printing and install/remove process that Dancing Banners™ clients may quickly and inexpensively change imagery on site themselves, keeping past images in storage for potential future use.

3. To allow for reliable installation of the dancing banner within windy environments.

Still further objects and advantages will become apparent from consideration of the ensuing description and drawings.

SUMMARY

In accordance with the present invention, a moving banner system is enhanced through the use of controllable torque friction brakes, removable printed sleeves, and strengthening lengthwise cable.

DESCRIPTION OF DRAWINGS

Block diagram figures are prefixed by "B" and mechanical figures are prefixed by "M".

In Reference Numerals In Drawing section, the phrase "Pre-existing matter." is used to denote items that are not elements presented for potential coverage under this patent application, but rather, were in use previously and provide physical context for the new elements. "New matter." refers to items that are being presented for potential patent coverage. (Note that "New matter." does not mean inappropriate new matter, but rather, the potentially newly patentable material.)

DRAWING FIGURES

FIG. B1 shows a block diagram of a typical embodiment of the Dancing Banners™, including the new enhancements of controllable torque friction brake, removable printed sleeves, and strengthening cable.

FIG. M2 shows a detail of the banner itself, including strengthening cable.

FIG. M3 shows a detail of the removable printed banner sleeves.

REFERENCE NUMERALS IN DRAWING

2 Surge suppressed power strip. (Pre-existing matter.)
4 Power Supply. (Pre-existing matter.)
6 Electronic Controller. (Pre-existing and new matter.)
8 CD Player. (Pre-existing matter.)
10 Audio Amplifier and Speakers. (Pre-existing matter.)
12 Emergency Stop Switch. (Pre-existing matter.)
14 Servo Motor and Integrated Amplifier. (Pre-existing matter.)
16 Controlled torque friction brake. (New matter.)
18 Elastic fabric banner itself (Pre-existing matter.)
20 Banner reinforcing cable. (New matter.)
22 Printed banner sleeves. (New matter.)
24 Floor for mounting. (Pre-existing matter.)
26 Ceiling for mounting. (Pre-existing matter.)
28 Banner struts. (Pre-existing matter.)
32 Removable sleeve securing elements. (New matter.)

SPECIFICATIONS

Description of Invention—FIGS. B1, M2, M3

FIG. B1 show a block diagram of a preferred Dancing Banners™ moving display embodiment with enhancements: controllable torque friction brakes 16, banner reinforcing cables 20, and printed banner sleeves 22.

All other elements, with the exception of electronic controller 6 that includes a new brakes 16-related element, existed previously and are commercially available through TechnoFrolics, 11 Miller Street, Somerville, Mass., www.technofrolics.com. Thus, their composition and function will be described only to the extent necessary to make the purpose, design, and function of the new enhancements clear.

Controllable Torque Friction Brakes 16

Brakes 16, shown in FIGS. B1 and M2, are ideally electrically controlled magnetic particle brakes such as is made by Placid Industries of Lake Placid, N.Y. Such magnetic particle brakes operate very quietly (typically below the human threshold of hearing when installed in a public space), have a very linear and defined functionality between input brake current and output torque friction that is substantially independent of rotational velocity, have low "off" friction, can be run oriented in any direction, and consume very little electrical power compared to that typically required to drive banner servo motors 14.

Brake 16's input current can be adjusted under computer control through any number of well known methods. In electronic controller 6, a simple Pulse Width Modulation (PWM) controller is implemented in an industry-standard manner.

The cost of brake 16 and its PWM drive system is a small fraction of the cost of servo motor and integrated amplifier 14.

Brakes 16 are mechanically attached to a rigid bar that is the width of the banner and is sewn into one end of banner 18, in a manner similar to how motors 14 are connected to the other end of banners 18.

While the features of electrically controlled magnetic particle brakes 16 make them ideal for the described application, it is to be understood that other controllable friction brakes such as hydraulic, pneumatic, or electromagnetically-controlled friction plate-based brakes, and others, can in certain installation circumstances be suitable as well. The key feature of any suitable brake is that the torque friction be controllable in a manner that is at least partially independent of rotational velocity. In particular, it is important that at low velocities, the friction can optionally be made high, and at high velocities, the friction can optionally be made low.

In addition, it is to be understood that while controllable torque friction brakes are particularly suited to the described Dancing Banners™ application, they may also be used to control the motions of banners (fabric and otherwise, elastic and otherwise) blowing in the wind, non-banner moving image elements such as metallic shapes driven with jets of water, and indeed, any moving display made up of kinetic elements and an energy input source (motors, wind, etc.).

Banner Reinforcing Cables 20

FIGS. B1 and M2 show banner reinforcing cables 20. The use of such substantially inelastic elements (as compared to the banner fabric itself, which is typically composed of a highly elastic nylon-spandex blend fabric similar to skin-tight swimwear) will dramatically increase the ability of the Dancing Banners™ to withstand significant winds.

Preferred materials for such a cable include Kevlar® made by Dupont, stainless steel and other similar high Young's modulus of elasticity (Young's modulus=Stress/Strain) materials. In other words, materials that stretch very little with applied force—i.e., inelastic, are required.

Cross sections for the cable 20 may be round, as in a wire, or flat, as in a narrow strip of Kevlar® fabric. The critical point is that the width of cable 20 is a small fraction (say not more than $1/20^{th}$) of the total width of banner 18. This requirement exists because as the banners 18 twist during their normal operation, while the centerline along their length (the path show traversed by cable 20) remains fixed in length, the outer edges of the banner 18 stretch. Thus, inelastic cable 20 must remain very near the center of banner 18.

Attachments of cable 20 to the shaft of motor 14 and to the shaft of brake 16 may be rigid (because the cable 20 itself can in most embodiments twist as much as, or more than, the banners 18 themselves), or free to swivel. It is expected that rigid attachment will in most cases be found superior for reasons of reliability.

If the cable is round, such as a stainless steel wire, it may effectively pass through holes drilled through the centers of struts 28. If the cable is a long narrow strip of Kevlar® fabric, then simply sewing it to the centerline of the banners 18 themselves is indicated.

While the features of cable 20 described above make it ideal for our application, it is to be understood that many other substantially inelastic materials such as fiberglass and carbon fiber maybe be used instead. Similarly, shapes other than round wire and flat strip, such as small diameter square tubing, may be effectively employed.

Printed Banner Sleeves 22

FIGS. B1 and M3 show sleeves 22. These hollow sleeves are typically made out of an elastic material similar to that of banners 18 themselves (such as a nylon-spandex blend fabric), and are sewn along their edges from two separate pieces of preprinted fabric using a zigzag weave to allow stretching as required during banners 18 twists.

To secure sleeves 22 to banners 18 in a convenient removable manner, a preferred method is to use a Buttoneer® button attachment tool made by Avery Dennison, Pasadena, Calif.

While the features of sleeves 22 and Buttoneer® attachment method are preferred in many applications, it is to be understood that alternative embodiments are suitable as well including:

- Securing sleeves 22 to banners 18 with needle and thread or other removable attachment method.
- Having two separate pieces of fabric unjoined, where each is attached to its separate banner 18 side with hook-and-loop tabs.
- Removable image elements composed of materials other than fabric.
- Other such variations.

Operation of Invention

Controllable Torque Friction Brakes 16

Pre-programmed or under live control through a user interface such as a joystick, sound sensor, or the like, changing input current to brakes 16 allows creation of controllable torque-based twists in banners 18, at any banner 18 rotational speed, from stopped (twist is put in just prior to stop) to high speed blur.

Banner Reinforcing Cables 20

Use of cables 20 prevents delicate elastic banners 18 from "spinnakering out". With such cables, wind load is transferred from elastic banners 18 to relatively inelastic rugged cables 20 that are securely fastened to rugged elements motor 14 shaft and brake 16 shaft.

Printed Banner Sleeves 22

In a preferred embodiment such as shown in FIGS. B1 and M3, sleeves 22 begin as white fabric. They are then printed with desired text and images, often using a CMYK process. Then they are sewn together along their edges with a zigzag stitch to allow for the necessary stretching during Dancing Banners™ operation. They are then slid onto banners 18 and secured to the underlying fabric with an appropriate attachment method such as a Buttoneer®. Typically, sleeves 22 are secured to banners 18 in at least sleeve 22's four opposing corners, with several additional attachments on the lips of the sleeve as show in FIG. M3.

It is best if the sleeve 22's length is just slightly greater than the strut 28 spacing, as that allows securing the sleeve 22 just outside the struts 28, which helps prevent sleeve 22 wrinkling.

CONCLUSION, RAMIFICATIONS, AND SCOPE OF INVENTION

Conclusion

Accordingly, the reader will see that the present Dancing Banners™ enhancements function to:

- Allow dramatic banner twists at any speed without requiring a second costly control motor per banner.
- Minimize power consumption over instances when two control motors per banner are used.
- Provide a method for reinforcing banners such that they may be installed in windy environments.
- Provide a method for cost-effectively and easily adding and removing imagery as needed without the requirement of replacing the entire underlying banner.

Ramifications and Scope

Although the descriptions above contain many specificities, these should not be construed as limiting the scope of the enhancements, but as merely providing illustrations of some of the presently preferred embodiments of these enhancements. Thus, the scope of the invention should be determined by the appended claims and their legal equivalents.

What is claimed is:

1. A method for dynamically affecting the appearance of a moving display that includes at least one energy input source, through application of at least one controllable torque friction brake to controllably alter the physical shape of the display;

whereby dramatic and diverse changes in visual appearance will be achieved for the purposes of art, entertainment, and advertising.

2. A method as claimed in claim 1 wherein said moving display is comprised of at least one moving banner.

3. A method as claimed in claim 2 wherein at least one said energy input source is comprised of an electric motor.

4. A method as claimed in claim 3 wherein at least one said electric motor is computer controlled.

5. A method as claimed in claim 2 wherein at least one said moving banner is comprised of elastic fabric.

6. A method as claimed in claim 5 wherein at least one said energy input source is comprised of a computer controlled motor and at least one said controllable torque friction brake is comprised of a computer controlled magnetic particle brake.

7. A method as claimed in claim 2 wherein at least one said controllable torque friction brake is comprised of an electrically controlled magnetic particle brake.

8. A method as claimed in claim 1 wherein at least one said controllable torque friction brake is comprised of an electrically controlled magnetic particle brake.

9. A method as claimed in claim 1 wherein at least one said controllable torque friction brake is computer controlled.

10. A method as claimed in claim 9 wherein said moving display is comprised of at least one moving banner.

* * * * *